US007897073B2

(12) United States Patent
Haag et al.

(10) Patent No.: US 7,897,073 B2
(45) Date of Patent: Mar. 1, 2011

(54) METHOD AND AUXILIARY MEANS FOR PRODUCING CONCRETE ELEMENTS, PARTICULARLY SEMI-FINISHED CONCRETE PRODUCTS AND/OR CONCRETE SLABS, AS WELL AS AUXILIARY MEANS FOR PRODUCING CONCRETE SLABS

(75) Inventors: Volker Haag, Darmstadt (DE); Alex Hauser, Zollikon (CH); Karsten Pfeffer, Wiesbaden (DE); Dejan Krecov, Glis (CH)

(73) Assignee: Cobiax Technologies AG, Zug (CH)

( * ) Notice: Subject to any disclaimer, the term of this patent is extended or adjusted under 35 U.S.C. 154(b) by 1045 days.

(21) Appl. No.: 10/598,312

(22) PCT Filed: Feb. 22, 2005

(86) PCT No.: PCT/CH2005/000105

§ 371 (c)(1),
(2), (4) Date: Aug. 24, 2006

(87) PCT Pub. No.: WO2005/080704

PCT Pub. Date: Sep. 1, 2005

(65) Prior Publication Data

US 2007/0186506 A1 Aug. 16, 2007

(30) Foreign Application Priority Data

Feb. 25, 2004 (DE) ..... 10 2004 009 741
Feb. 25, 2004 (DE) ..... 20 2004 003 071 U
Oct. 4, 2004 (EP) ..... 04023566

(51) Int. Cl.
*E04B 1/16* (2006.01)

(52) U.S. Cl. ..... 264/35; 264/34; 264/308; 264/228; 264/297.9; 264/241; 264/271.1; 52/742.14; 52/576; 52/79.11; 52/42.14; 52/405.1

(58) Field of Classification Search ..... 264/35, 264/308, 228, 297.9, 241, 271.1, 34; 52/742.14, 52/576, 79.11, 42.14, 405.1
See application file for complete search history.

(56) References Cited

U.S. PATENT DOCUMENTS 3,213,581 A * 10/1965 Macchi ..... 52/382
3,930,348 A * 1/1976 Wise ..... 52/600
4,495,744 A * 1/1985 Carl ..... 52/576

(Continued)

FOREIGN PATENT DOCUMENTS

DE 3714581 A 11/1988

(Continued)

OTHER PUBLICATIONS

Oster, W099/64693, Dec. 1999, European Patent Office English Translation.*

*Primary Examiner* — Khanh Nguyen
*Assistant Examiner* — Saeed M Huda
(74) *Attorney, Agent, or Firm* — Pearne & Gordon LLP

(57) ABSTRACT

Displacers are used in production of concrete surfaces. The displacers are embodied, for example, as plastic balls or plastic shells and are locked in lattices that are open on one side, preferably downwardly. The modules can then be pressed into a first or second concrete layer that can already contain a first reinforcement mesh. The thus produced semi-finished product can then be covered with a concrete mass during the subsequent finishing process.

15 Claims, 7 Drawing Sheets

U.S. PATENT DOCUMENTS

Figure 1:
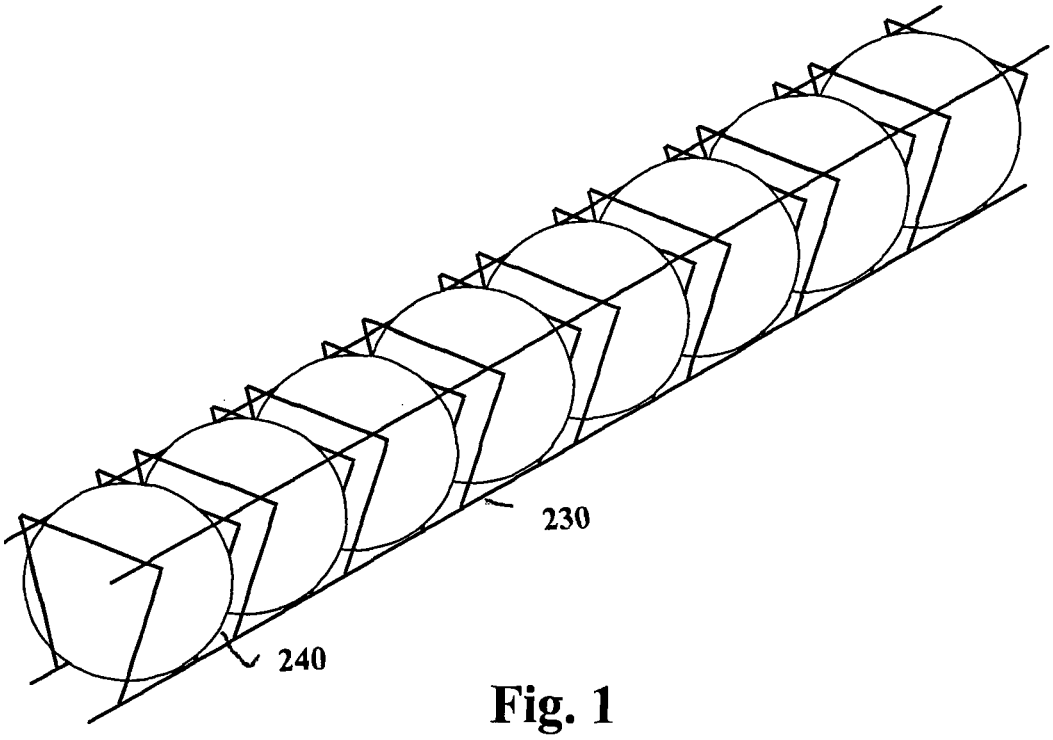

| | | | | | |
|---|---|---|---|---|---|
| 4,702,048 | A | * | 10/1987 | Millman | 404/34 |
| 5,055,252 | A | * | 10/1991 | Zimmerman | 264/263 |
| 5,074,095 | A | * | 12/1991 | Wilnau | 52/745.2 |
| 5,396,747 | A | * | 3/1995 | Breuning | 52/516 |
| 5,797,230 | A | * | 8/1998 | Lassen | 52/323 |
| 6,753,081 | B1 | * | 6/2004 | Lovett et al. | 428/373 |

FOREIGN PATENT DOCUMENTS

| | | | |
|---|---|---|---|
| FR | 1 245 120 | A | 11/1960 |
| FR | 2 125 534 | A | 9/1972 |
| WO | 94 29541 | A | 12/1994 |
| WO | 99 64693 | A | 12/1999 |
| WO | 02 092935 | A | 11/2002 |

* cited by examiner

METHOD AND AUXILIARY MEANS FOR PRODUCING CONCRETE ELEMENTS, PARTICULARLY SEMI-FINISHED CONCRETE PRODUCTS AND/OR CONCRETE SLABS, AS WELL AS AUXILIARY MEANS FOR PRODUCING CONCRETE SLABS

The present invention pertains to a method for producing concrete elements, particularly semi-finished concrete products and/or concrete slabs (ceiling or floor). According to a second aspect, the invention furthermore pertains to auxiliary means for producing concrete elements, particularly semi-finished concrete products and/or concrete slabs. A third aspect of the invention pertains to concrete elements, particularly semi-finished concrete products and/or concrete slabs.

German Offenlegungsschrift DE-A-2 116 479 describes spherical core elements for concrete plates, each of which is provided with two through-bores that perpendicularly intersect in the center of the element. The core elements consequently can be arranged in rows on correspondingly intersecting reinforcing irons that can be fixed on a reinforcement. Subsequently, the two-dimensional arrangement of the core elements with the reinforcing irons and the reinforcement is encased in concrete in order to produce the flat ceiling/floor.

European Offenlegungsschrift EP-A-0 552 201 describes a hollow floor plate with reinforced concrete in the form of a two-dimensional structure, in which respectively closed, hollow plastic balls are caged in a reinforcing lattice of iron rods such that they are uniformly spaced apart in both perpendicular directions. The reinforcing lattice consists of an upper, essentially plane lattice that is connected to a lower lattice realized in an essentially plane fashion by means of wires or the like. According to the information provided in EP-A-0 552 201, it is imperative for the realization of this known invention that the displacers protrude into the upper and the lower reinforcing lattice. This not only appears unnecessary, but also disadvantageous because it prevents a modularity of the construction principle and they can only be produced by means of specially prepared lattices with grid apertures of corresponding dimensions for the displacers.

According to EP-A-0 552 201, it is necessary to utilize specially prepared wire mesh arrangements with definite dimensions for the production of a flat slab. This either requires a welding system for wire mesh arrangements with definite dimensions at the prefabrication facility or the procurement of comparatively expensive welded wire meshes from an external manufacturer.

In addition, adapted lattice carriers are required that need to be precisely fitted between the lower and the upper reinforcement. In this case, it is only possible to realize a project-oriented production because the hollow elements form one unit together with the supporting reinforcement and the lattice carriers. This means that a separately dimensioned and calculated lattice needs to be prepared for each type of flat slab to be produced.

Anyhow, it is known from the above-cited patent publications that it may be advantageous to incorporate light-weight elements into the zone of a concrete slab that has rather neutral static characteristics, namely because this region cannot significantly contribute to the stability of the slab and a weight reduction therefore appears possible and sensible.

However, it was determined that a modular production of a concrete layer that is lighter in the central region could be significantly simplified with the prefabrication of semi-finished products, in this case semi-finished concrete products. This modular production can be additionally simplified if displacer elements are used for the production of these semi-finished concrete products that can be incorporated into the semi-finished products or even into the concrete elements—as it is the case in a continuous production—in a standardized fashion.

JP-A-2003/321894 discloses a module that serves as a sort of positioning aid and is placed over a plurality of displacers in order to arrange the displacers on a semi-finished concrete slab. Among other things, this method has the disadvantage that the positioning needs to be carried out at the construction site and the prefabrication of the modules cannot be realized to the desired degree.

The invention, in contrast, is based on the objective of simplifying the initially cited flat slab module. The invention aims, in particular, to disclose a method in which the disadvantages of the production methods according to the state of the art are eliminated. Another objective of the invention consists of proposing auxiliary means that allow a simplified and, in particular, modular production of concrete elements. Corresponding concrete elements are also proposed. According to the invention, it is advantageous that flexible recesses can be modularly realized in the slab cross section for the installation of prestressing means, ventilation channels, heating ducts, cooling ducts, electric cables, plumbing elements, etc.

According to the invention, this objective is attained with a method according to claim 1. In this case, the measures disclosed by the invention initially result in the proposed method making it possible to produce semi-finished concrete products in series or quasi in series. In addition, the modules with the displacers also can be largely produced in series regardless of the dimensions of the subsequent semi-finished products and the prefabricated slabs.

According to the present invention, this is achieved in that a hollow element strip of a lattice with a linear row of displacers is not dependent on the static and dynamic properties of the flat slab and is self-supporting—with respect to the hollow element strip. The invention advantageously decouples the function of the concrete displacement by means of the displacers from the supporting function of the reinforcement. Consequently, the invention is no longer dependent on the characteristics of the respective project and allows the rational production of standard modules that merely need to be sized to the desired length at the construction site or the prefabrication facility. A project-oriented arrangement of the hollow element strips (modules) makes it possible, in particular, to modularly realize flexible recesses in the slab cross section for the installation of prestressing means, ventilation channels, heating ducts, cooling ducts, electric cables, plumbing elements, etc.

The dimensioning of the rods that form the lattice therefore is merely defined in that the modules with the relatively light-weight displacers remain self-supporting. The module consequently has a relatively low weight and can be manipulated with the simple hoisting gear. The inventive module is simply placed on the completely calculated flat slab board and, if so required, merely connected to the reinforcement as far as required for fixing the position of the module. However, it is preferred to press or vibrate the module into the still workable concrete.

The invention can be realized without any welding processes at the prefabrication facility or the construction site. If a flat slab board requires that several modules be arranged parallel to one another, said modules do not have to be interconnected. The rods may consist of structural steel or of plastic or other materials. Subsequently, the module or the modules and the flat slab board are collectively covered with concrete. The displacers may consist of hollow elements such as, for example, hollow balls, downwardly open or closed hollow shells, hollow ellipsoids or hollow cuboidal elements or hollow cubes or equivalent shapes of plastic or the like, or of a solid material that has the aforementioned or different geometric shapes and is significantly lighter than concrete.

The inventive module may be realized in such a way that it features several parallel strips that are interconnected in order to fix the relative position between the strips. The cross-sectional shape of the lattice can be advantageously adapted to the position of the respective reinforcement for the flat slab board so as to achieve a comfortable attachment of the module or the modules to the reinforcement.

In contrast to the characteristics disclosed in JP-A-2003/321894, the modular embodiment proposed by the present invention provides particular transport and prefabrication advantages. These prefabrication advantages manifest themselves, in particular, if modules are simply arranged between upright reinforcing elements of the concrete.

Other advantageous embodiments of the invention are disclosed in the dependent claims.

The aforementioned elements, as well as the claimed elements to be used in accordance with the invention that are described with reference to the following embodiments, are not subject to any particular exceptional conditions with respect to their size, shape, material and technical concept such that the selection criteria known from the respective field of application can be applied in an unrestricted fashion. It would be possible, in particular, to realize the lattice-like arrangement of the displacers with metal lattices, particularly steel components that are conventionally used for construction purposes, or with plastic components—particularly plastics that are reinforced, for example, with carbon fibers (CFRP) or aramide fibers—without restricting the material selection in any way. It should also be noted that the measures proposed by the invention are suitable for the prefabrication in a concrete prefabrication facility as well as for the production of concrete floors/ceilings (slabs) that are cast-in-place (in situ).

Other details, characteristics and advantages of the object of the invention result from the following description of the corresponding figures that show—in an exemplary fashion—a corresponding method, the advantageous auxiliary means and a concrete slab according to the present invention.

Figure 2:
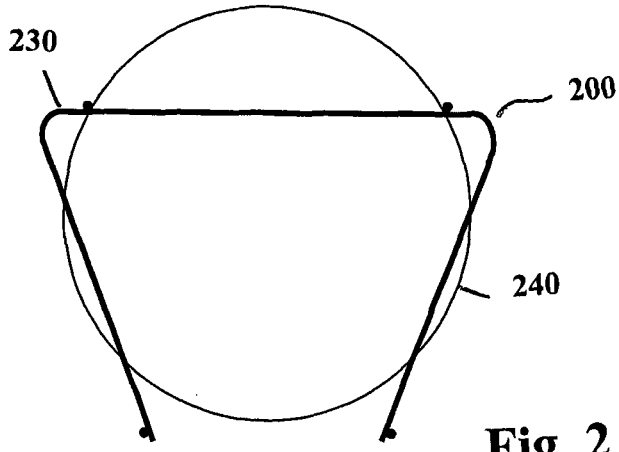
Figure 3:
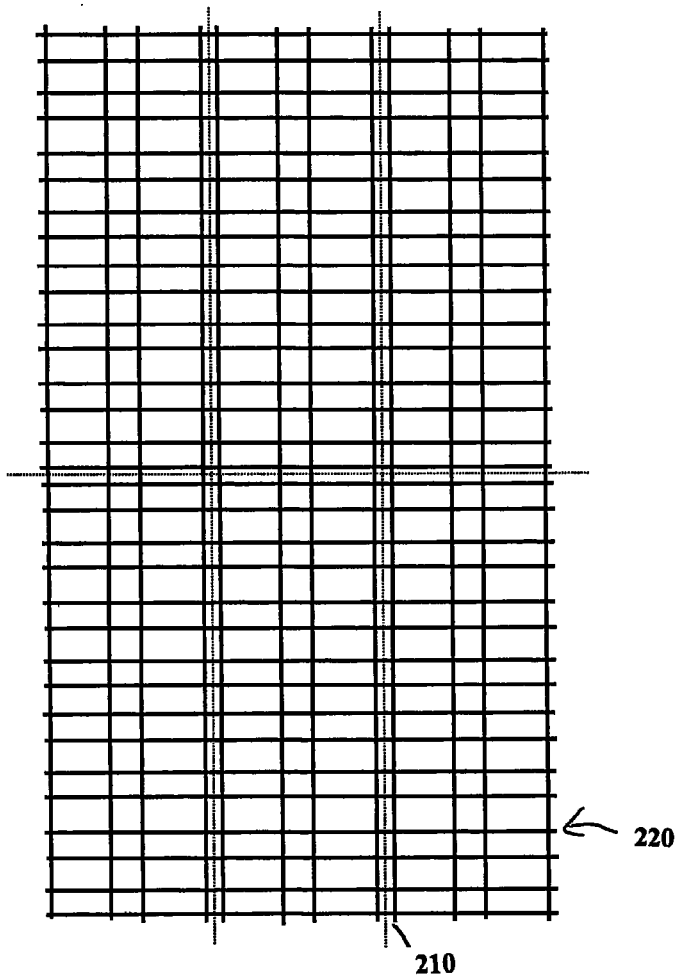
Figure 4:
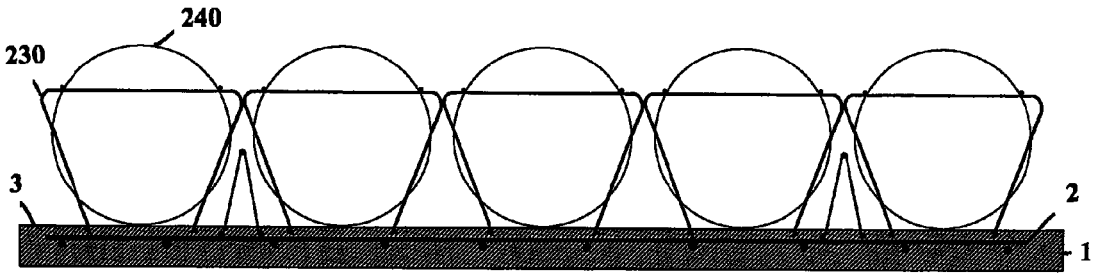
Figure 5:
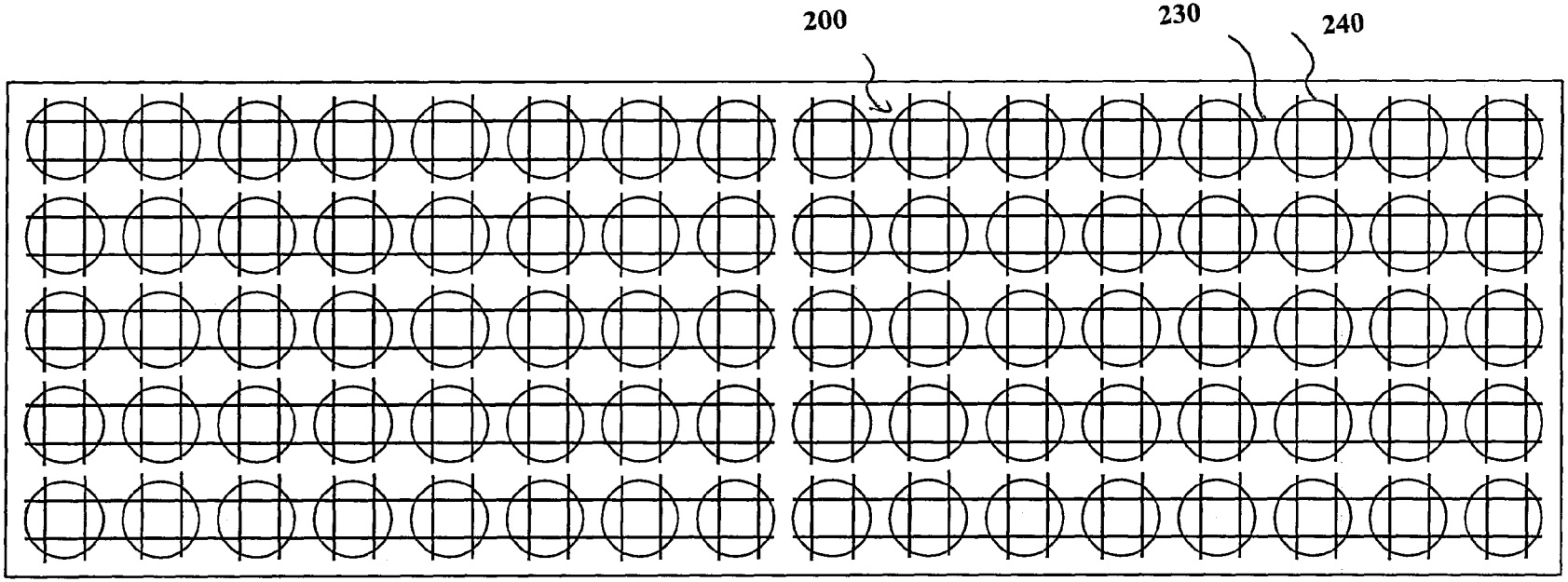
Figure 6:
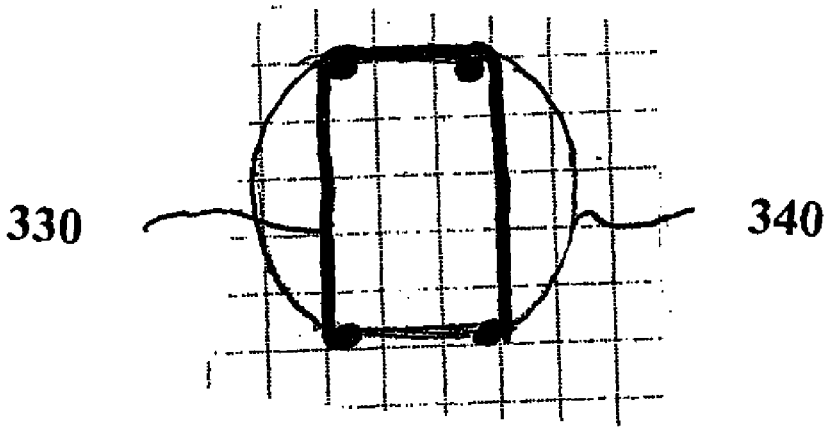
Figure 7:
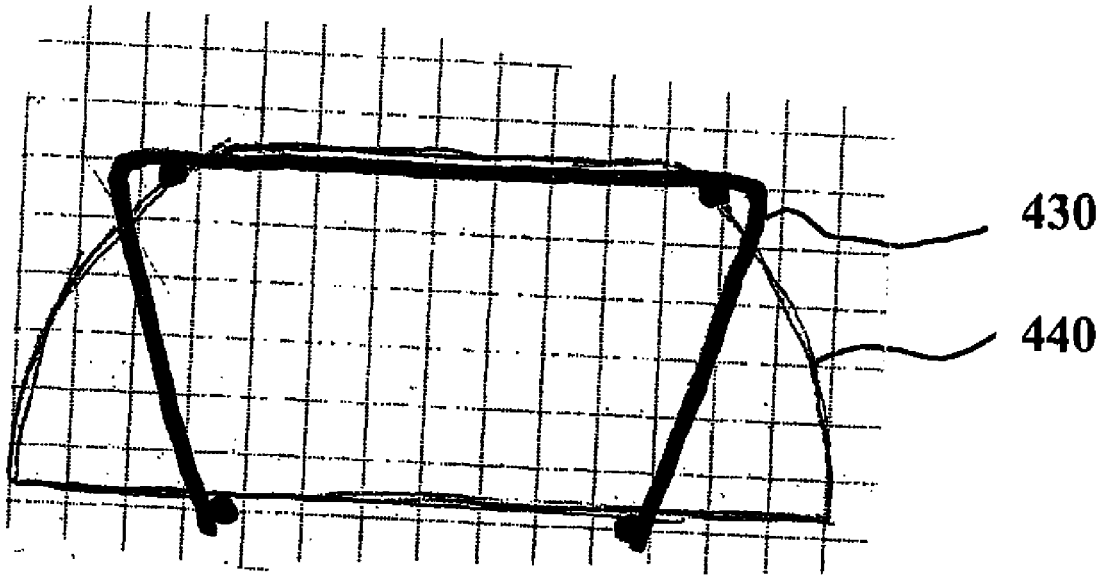
Figure 8:
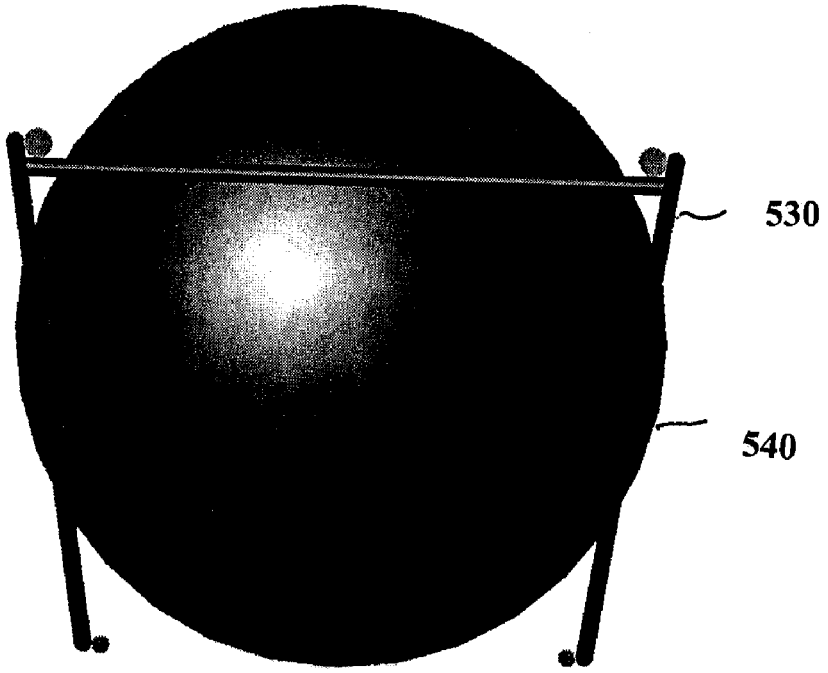
Figure 10:
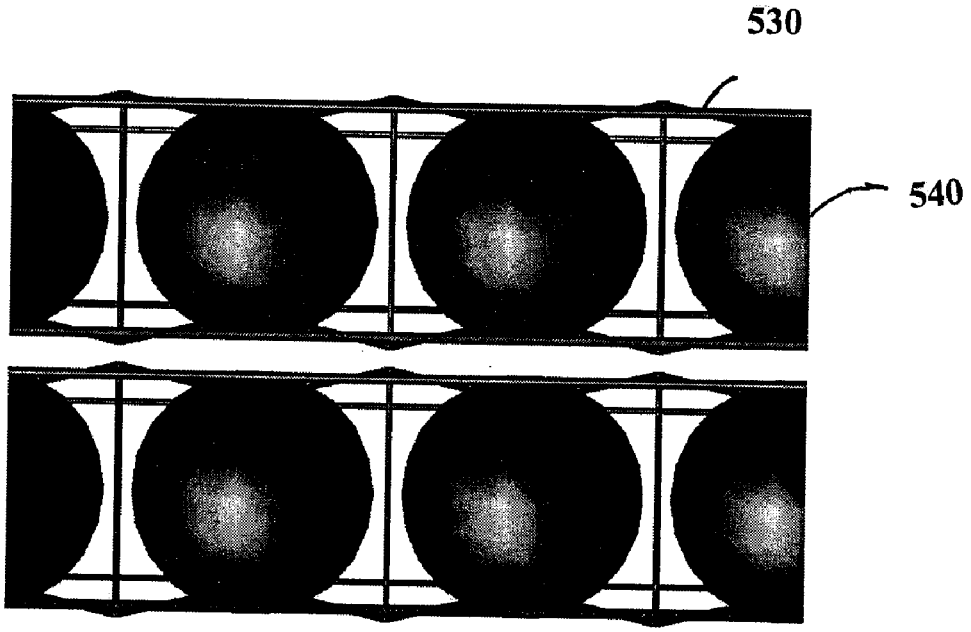
Figure 9:
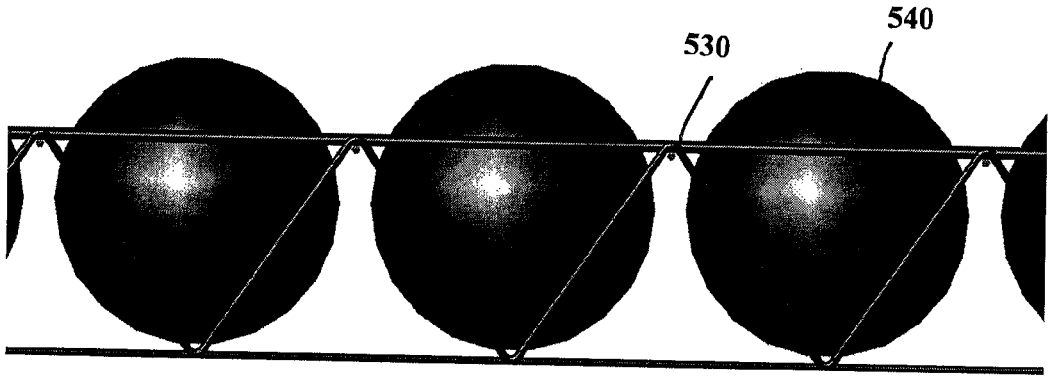
Figure 11:
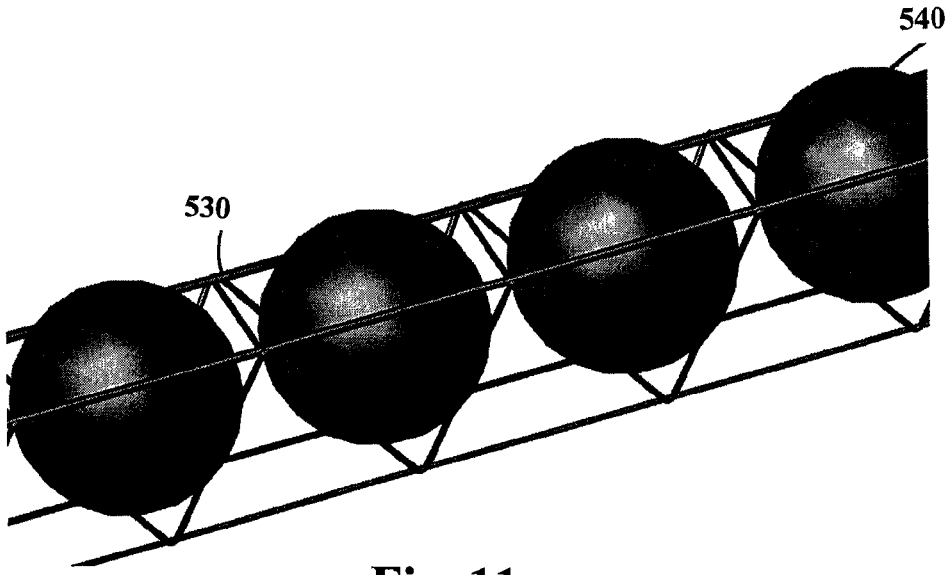
Figure 12:
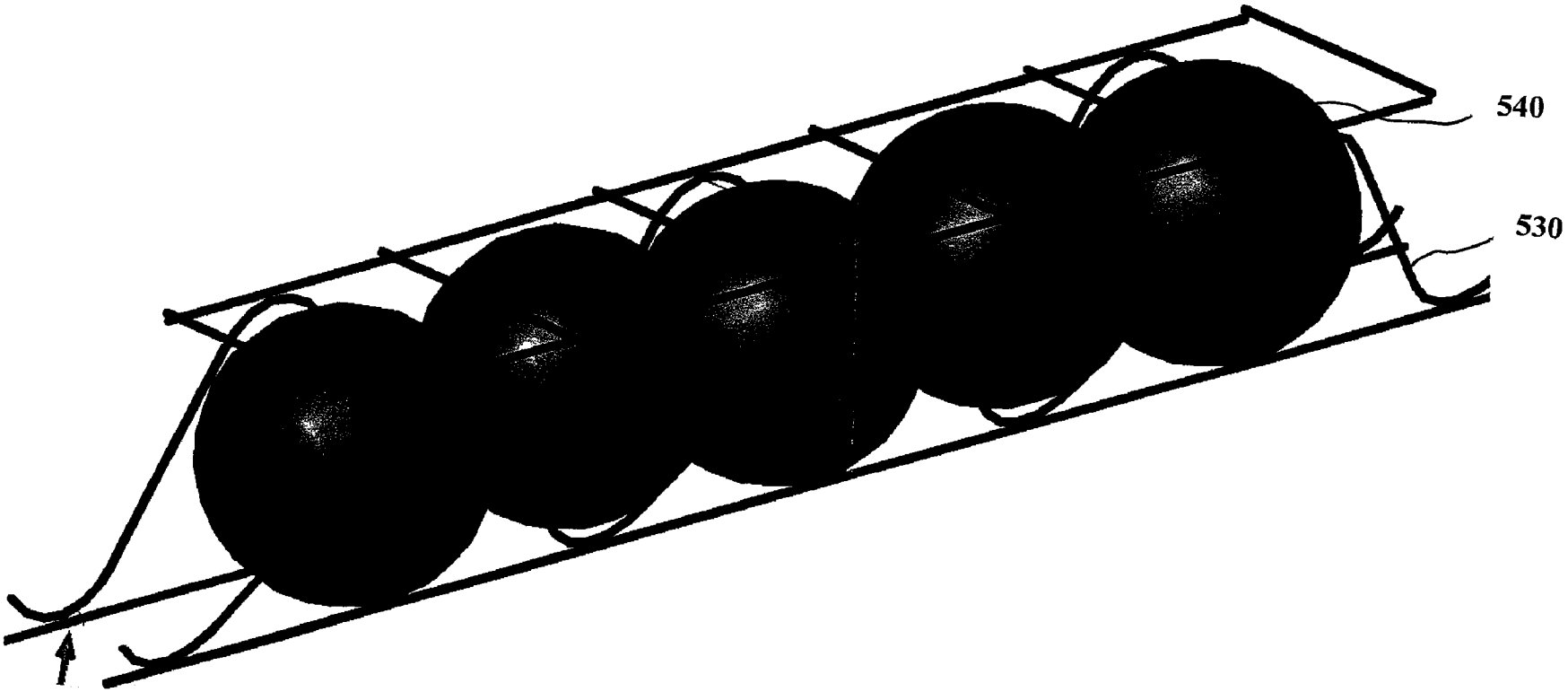

The respective figures show:

FIG. 1, a perspective representation of a module according to a first embodiment of the present invention with displacers that are fixed in a lattice construction;

FIG. 2, a front view of the module according to FIG. 1;

FIG. 3, a typical welded wire mesh before it is cut and bent in order to be used in accordance with the present invention for the production of a lattice construction according to FIG. 1;

FIG. 4, a front view of an adjacently arranged plurality of modules according to FIG. 1 that are placed onto a reinforced concrete layer;

FIG. 5, a top view of an arrangement according to FIG. 5 with a plurality of such modules that are arranged adjacent to and behind one another;

FIG. 6, a front view of a second embodiment of the present invention;

FIG. 7, a front view of a third embodiment of the present invention;

FIG. 8, a front view of a fourth embodiment of the present invention;

FIG. 9, a perspective side view of the fourth embodiment of the present invention according to FIG. 8;

FIG. 10, a perspective top view of the fourth embodiment of the present invention according to FIG. 8;

FIG. 11, a perspective oblique view of the fourth embodiment of the present invention according to FIG. 8, and FIG. 12, a perspective oblique view of a fifth embodiment of the present invention.

The module according to a first embodiment that is identified by the reference symbol 200 in FIG. 1 and FIG. 2 is realized in the form of an element consisting of a wire mesh arrangement 220 with definite dimensions that is illustrated in FIG. 3 and then bent by an angle of approximately 95° along the two inner rods. In the embodiment shown, 8 to 10 plastic balls 240 (plastic spheres) are pressed into this downwardly open lattice construction 230, if so required, by slightly alleviating the two lateral lattice elements at the positions, at which the respective plastic balls are pressed in. In the embodiment shown, the lattice construction is realized such that the plastic balls 240 upwardly protrude from the lattice. This ensures a stable construction.

In one special embodiment of the invention, the displacers are not realized in the form of solid spheres, but rather flattened on the upper side such that they form a defined surface—on which persons are preferably able to walk. In this case, the displacers have an oriented position.

In another embodiment that may also be combined with the above-described embodiment, the displacers consist of several parts, wherein the individual parts—in this case two parts—are joined with the aid of a locking mechanism, e.g., a bayonet catch or a click-stop interlocking mechanism.

In FIGS. 4 and 5, a plurality of the above-described modules 200 is arranged adjacent to one another. These modules contact one another in the upper region, but are not interconnected. In FIG. 5, the modules 200 are already pressed into a first concrete layer.

The method according to the preferred embodiment of the present invention is carried out in the steps described below: initially, semi-finished products are produced, namely prefabricated and partially reinforced concrete plates. These semi-finished products are produced in accordance with the method described below:

a. A first layer 1 of a concrete mass is filled into a formwork and begins to set.
b. A reinforcing mesh 2 is placed on the semi-set first layer 1. The reinforcing mesh 2 consists of conventional welded wire mesh.
c. A second layer 3 of a concrete mass is filled into the formwork on top of the first layer 1 and the reinforcing mesh and begins to set.
d. Elements 200 with a plurality of adjacently arranged displacers, namely plastic balls 240 in the embodiment shown, are pressed into the semi-set, but still workable second layer 3. The plurality of adjacently arranged plastic balls (displacers) 240 is respectively arranged in a lattice 230 according to the previous description, wherein part of the plastic balls 240 upwardly protrudes from the lattice.
e. The concrete masses are allowed to set and the thusly produced semi-finished product is removed from the formwork.

Naturally, steps a through c can also be combined in a common step, wherein the reinforcement is held in position with the aid of any suitable auxiliary means known from the state of the art while the concrete mass is filled into the formwork.

The thusly produced semi-finished product is intended for being additionally processed as described below:

a. The semi-finished product is installed on the prepared shoring at the construction site.

b. If so required, an additional reinforcing mesh is placed on the hollow element strips (modules) of the semi-finished product.

c. An additional concrete layer is applied. With respect to the number of concrete layers to be produced, this additional concrete pouring process can be optionally carried out in accordance with the respective requirements. The last concrete layer then forms the upper side of the finished concrete slab.

In one special embodiment of the method according to the present invention, additional lattice carriers are provided that upwardly protrude from the prefabricated concrete before the module 200 is arranged in position. These additional lattice carriers then form rows, between which the modules—namely two modules in this special embodiment—are inserted, but not interconnected. In this embodiment, the spacing of these rows from the lattice carriers and the width of the modules 200 naturally are dependent on one another. However, the important aspect is that the height of the lattice carriers is—in contrast to the state of the art according to EP-A-0 552 201—not at all dependent on the hollow element strips (modules) and not connected thereto.

In the second embodiment according to FIG. 6, the lattice cages are only bent by an angle of 90°. The lattice construction therefore is right-angled. The (hollow) displacer balls 340 of plastic are flattened on the top and on the bottom in this case. Although the displacers are downwardly closed in this embodiment, they may also be open on the bottom. With a typical ball diameter of 22.5 cm and a height of 18 cm (due to the flattening of the balls), this embodiment represents an optimization of the linear installation space for thin slabs in the longitudinal direction.

In the third embodiment according to FIG. 7, the lattice rods 430 are bent by approximately 115°, and the displacers 440 are realized in the form of downwardly open—alternatively: downwardly closed—spherical shells with an upper flattening. Thus, the lattices of the lattice-work situated adjacent to the open side are inclined relative to the lattice of the lattice-work situated opposite of this open side by an angle of approximately 90° to 135°, preferably 95° to 120°, as shown in FIGS. 1-2 and FIGS. 6-8. Although it needs to be ensured that such downwardly open displacers 440 are not partially filled with concrete from the inside during the pouring of the concrete mass, this problem could be solved by pressing in the displacers with a higher force. This concept is also particularly suitable for thin concrete slabs, wherein this embodiment is realized differently than the honeycomb construction of the first embodiment.

In the fourth embodiment according to FIGS. 8 through 11, the lattices 530 are laterally realized with a respective triangular construction rather than perpendicular rods. In this embodiment, the triangular construction is respectively offset on both sides by half the width of a triangle. The advantage of this embodiment can be seen in that the lattice carrier function is integrated into the lattice construction. Consequently, reinforcing elements in the form of additional lattice carriers (FIG. 4) can be eliminated in any case. It should also be noted that the lattice construction in this embodiment is not realized by bending wire mesh arrangements with definite dimensions, but rather a special production method. Consequently, it would be easily possible—as in the embodiment shown—to realize the triangular elements of a high-strength material such as steel rods or CFRP rods and to utilize a second material with a lower load bearing capacity (and possibly also a reduced thickness) for the longitudinal connection and the upper lateral connection. In one variation of this embodiment—that represents a fifth embodiment of the present invention—a lattice with displacer balls arranged therein is shown. In this embodiment, the lateral lattice elements are realized in the form of rods that are curved in a wave-shaped fashion, wherein an optimal adaptation of the force ratios can be achieved in this case.

According to the present invention, a person skilled in the art has the option of choice and, in accordance with this description, may freely combine individual characteristics with one another.

The invention claimed is:

1. A method for producing concrete elements, particularly semi-finished concrete products, the method comprising:

filling a first layer of concrete mass into a formwork and allowing the first layer to set, resulting in at least a semi-set first layer of concrete mass;

placing a reinforcing mesh onto the semi-set first layer, wherein the reinforcing mesh consists of conventional welded wire mesh;

filling a second layer of concrete mass into the formwork on top of the first layer and the reinforcing mesh and allowing the second layer to set, resulting in at least a semi-set second layer of concrete mass;

pressing modules (200, 300, 400, 500) comprising a plurality of adjacently arranged displacers, the displacers comprising one of plastic balls (240) or plastic shells (440), into the semi-set second layer, wherein the plurality of adjacently arranged displacers (240, 440) is respectively arranged in a lattice-work (230, 330, 430, 530) of rods;

allowing the first and second concrete masses to set and removing the resulting semi-finished product from the formwork, wherein the lattice-work is open toward one side, the one side being downward, wherein lattices of the lattice-work that are situated adjacent to this open side are inclined relative to a lattice of the lattice-work that is situated opposite of this open side by an angle of approximately 90° to 120°, and wherein the modules are produced by caging the displacers (120, 340, 440, 540) in the lattice-work (230, 330, 430, 530), such that at least part of the lattices extend beyond the displacers on the downward side of the lattice-work.

2. A method for producing concrete elements, particularly semi-finished concrete products, comprising the steps:

placing reinforcing elements comprising lattice-like reinforcing elements into a formwork, filling a layer of concrete mass into the formwork and allowing it to set to become a workable semi-set layer of concrete mass;

pressing modules (200, 300, 400, 500) comprising a plurality of adjacently arranged displacers the displacers comprising one of plastic balls (240) or plastic shells (440), into the semi-set layer, wherein the plurality of adjacently arranged displacers (240, 340, 440, 540) is respectively arranged in a lattice-work (230, 330, 430, 530) of rods, allowing the layer of concrete mass to set and the resulting semi-finished product is removed from the formwork, wherein the lattice-work is open toward one side, the one side being downward, wherein lattices of the lattice-work situated adjacent to this open side are inclined relative to a lattice of the lattice-work situated opposite of this open side by an angle of approximately 90° to 120°, and wherein the modules are produced by caging the displacers (240, 340, 440, 540) in the lattice-work (230, 330, 430, 530), such that at least part of the lattices extend beyond the displacers on the downward side of the lattice-work.

3. The method according to claim 1 or 2, characterized in that the modules (200, 300, 400) are produced from welded wire mesh sections that are cut to size, namely by respectively bending a lattice-work (230, 330, 430, 530).

4. The method according to claim 1 or 2, characterized in that the modules are produced from downwardly open lattice constructions that respectively feature an essentially triangular construction on sides of the lattice-work.

5. The method according to claim 4, characterized in that the lateral rod constructions on one side of the lattice-work are offset relative to the other side of the lattice-work by approximately half the width of the triangular construction.

6. The method according to one of claims 1-2, characterized in that the modules comprise plastic parts.

7. The method according to one of claims 1-2, characterized in that the modules comprise shells.

8. The method according to one of claims 1-2, characterized in that the displacers have at least one of a flat upper side and/or lower side.

9. The method according to one of claims 1-2, characterized in that the displacers are downwardly open.

10. The method according to one of claims 1-2, characterized in that part of the displacers (240) upwardly protrudes from the lattice-work (230).

11. The method according to one of claims 1-2, characterized in that several modules (200, 300, 400, 500) are pressed into the semi-set concrete mass parallel to one another.

12. The method according to claim 2, characterized in that the reinforcing elements or the reinforcing mesh are interconnected in order to be fixed.

13. The method according to one of claims 1-2, characterized in that a space remaining between the displacers (240) and lower reinforcing meshes is filled with concrete mass.

14. The method according to one of claims 1-2, wherein the method further comprises forming an upper most concrete layer on an upper side of the finished element.

15. The method according to claim 1, characterized in that the reinforcing mesh is interconnected in order to be fixed.

* * * * *